US006897829B2

(12) United States Patent
Oliver et al.

(10) Patent No.: US 6,897,829 B2
(45) Date of Patent: May 24, 2005

(54) PHASED ARRAY ANTENNA PROVIDING GRADUAL CHANGES IN BEAM STEERING AND BEAM RECONFIGURATION AND RELATED METHODS

(75) Inventors: Thomas Robert Oliver, Casselberry, FL (US); Harry Richard Phelan, Palm Bay, FL (US); Richard John Nink, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/867,463

(22) Filed: Jun. 14, 2004

(65) Prior Publication Data

US 2005/0001784 A1 Jan. 6, 2005

Related U.S. Application Data

(63) Continuation-in-part of application No. 10/303,580, filed on Nov. 25, 2002, now Pat. No. 6,842,157, which is a continuation-in-part of application No. 09/911,350, filed on Jul. 23, 2001, now Pat. No. 6,456,244.

(51) Int. Cl.[7] ..... H01Q 21/00

(52) U.S. Cl. ..... 343/893; 343/895; 343/853; 343/702; 342/372

(58) Field of Search ..... 343/700 MS, 702, 343/824, 893, 895, 853; 342/372, 375

(56) References Cited

U.S. PATENT DOCUMENTS

| | | | | |
|---|---|---|---|---|
| 4,052,723 A | | 10/1977 | Miller | 343/100 |
| 4,465,373 A | | 8/1984 | Tamaki et al. | 356/374 |
| 5,175,561 A | | 12/1992 | Goto | 343/769 |
| 5,262,790 A | | 11/1993 | Russo | 343/700 |
| 5,293,176 A | | 3/1994 | Elliot | 343/797 |
| 5,327,146 A | | 7/1994 | Jeon | 343/700 MS |
| 5,386,215 A | | 1/1995 | Brown | 343/795 |
| 5,539,413 A | | 7/1996 | Farrell et al. | 342/372 |
| 5,589,728 A | | 12/1996 | Levine et al. | 313/336 |
| 5,600,342 A | | 2/1997 | Pikulski et al. | 343/909 |
| 5,711,694 A | | 1/1998 | Levine et al. | 445/24 |
| 5,808,784 A | | 9/1998 | Ando et al. | 459/443 |
| 5,815,122 A | | 9/1998 | Nurnberger et al. | 343/767 |
| 5,838,284 A | | 11/1998 | Dougherty | 343/893 |
| 5,955,994 A | | 9/1999 | Staker et al. | 343/700 |
| 6,147,657 A | | 11/2000 | Hildebrand et al. | 343/844 |
| 6,175,671 B1 | | 1/2001 | Roberts | 385/14 |
| 6,205,224 B1 | | 3/2001 | Underbrink et al. | 381/92 |
| 6,211,841 B1 | | 4/2001 | Smith et al. | 343/813 |
| 6,252,542 B1 | | 6/2001 | Sikina et al. | 342/174 |
| 6,300,918 B1 | * | 10/2001 | Riddle et al. | 343/895 |
| 6,456,244 B1 | * | 9/2002 | Goldstein et al. | 343/700 MS |
| 6,522,293 B2 | | 2/2003 | Vail et al. | 342/372 |
| 6,522,294 B2 | | 2/2003 | Vail et al. | 342/372 |
| 6,525,697 B1 | | 2/2003 | Theobold | 343/895 |
| 6,573,863 B2 | * | 6/2003 | Vail et al. | 342/372 |
| 6,646,621 B1 | * | 11/2003 | Phelan et al. | 343/895 |
| 6,781,560 B2 | * | 8/2004 | Goldstein | 343/895 |
| 6,842,157 B2 | * | 1/2005 | Phelan et al. | 343/893 |
| 2003/0142035 A1 | | 7/2003 | Goldstein | 343/895 |

OTHER PUBLICATIONS

Excerpt from DD(X) System Design, Harris Corporation proposal document, presented Jan. 27, 2003.

* cited by examiner

*Primary Examiner*—Tan Ho
(74) *Attorney, Agent, or Firm*—Allen, Dyer, Doppelt, Milbrath & Gilchrist, P.A.

(57) ABSTRACT

A phased array antenna may include a substrate and an array of antenna elements carried thereby, and the antenna elements may be arranged along an imaginary spiral. The antenna may further include at least one control element connected to each antenna element, and at least one controller serially communicating with the control elements so that updated control data for beam steering is sequentially implemented by the control elements to thereby cause a gradual change in beam steering.

35 Claims, 6 Drawing Sheets

PHASED ARRAY ANTENNA PROVIDING GRADUAL CHANGES IN BEAM STEERING AND BEAM RECONFIGURATION AND RELATED METHODS

CROSS-REFERENCE TO RELATED APPLICATIONS

This application is a continuation-in-part of U.S. application Ser. No. 10/303,580, filed Nov. 25, 2002, now U.S. Pat. No. 6,842,157 which, in turn, is a continuation-in-part of U.S. application Ser. No. 09/911,350, filed Jul. 23, 2001, now U.S. Pat. No. 6,456,244, all of which are hereby incorporated herein in their entireties by reference.

FIELD OF THE INVENTION

The present invention relates to the field of antenna systems, and, more particularly, to phased array antennas and related methods.

BACKGROUND OF THE INVENTION

Antenna systems are widely used in both ground based applications (e.g., cellular antennas) and airborne applications (e.g., airplane or satellite antennas). For example, so-called "smart" antenna systems, such as adaptive or phased array antennas, combine the outputs of multiple antenna elements with signal processing capabilities to transmit and/or receive communications signals (e.g., microwave signals, RF signals, etc.). As a result, such antenna systems can vary the transmission and/or reception pattern of the communications signals.

For example, each antenna element typically has a respective phase shifter and/or gain element associated therewith. The phase shifters/gain (i.e., amplitude control) elements may be controlled by a central controller, for example, to adjust respective phases/amplitudes of the antenna elements across the array. Thus, it is not only possible to steer the antenna beam, but it is also possible to perform beam shaping and/or adjust beam width (i.e., "spoiling") to receive or transmit over different areas. Another advantage of phased array antennas is that the array of elements may be arranged in sub-groups, and each of the sub-groups used for different antenna beams to thus provide multi-beam operation.

One example of a phased array antenna is disclosed in the above-noted U.S. patent application Ser. No. 10/060,497, which is assigned to the present Assignee. This application discloses a phased array antenna which includes a substrate and a plurality of spaced apart phased array antenna elements carried by the substrate and arranged along an imaginary Archimedean spiral. The imaginary Archimedean spiral includes a plurality of levels, and a spacing between adjacent pairs of phased array antenna elements along the imaginary Archimedean spiral is substantially equal to a radial spacing between adjacent levels. Among other advantages, this antenna configuration reduces occurrences of grating and/or high gain side lobes, yet is relatively easily scalable for numerous applications.

The advantages of such a spiral antenna element configuration may also be extended to relatively large antenna configurations. By way of example, the above-noted U.S. Pat. No. 6,456,244, which is assigned to the present Assignee, discloses a phased array antenna including a plurality of aperiodic antenna element subarrays, and the subarrays are in turn arranged in an aperiodic array. The subarrays may be arranged in the form of spirals, for example, or in other geometric shapes, as disclosed in the above-noted U.S. application Ser. No. 10/303,580, which is also assigned to the present Assignee. The antenna may similarly perform amplifying, phase shifting and beam forming on transmitted or received signals with reduced side lobes. In addition, because of the aperiodic configuration, the electronic circuitry can be mounted between antenna elements.

As the size and complexity of phased array antennas grows, so too does the need for efficient control circuitry for managing the beam steering and beam shaping data which has to be communicated to hundreds or even thousands of elements. One particularly efficient phased array antenna control architecture is disclosed in U.S. Pat. No. 6,573,863 which is assigned to the present Assignee. In particular, this application discloses a phased array antenna system which includes a plurality of antenna element controllers connected to the phased array antenna elements, and at least one higher level controller connected to the plurality of antenna element controllers. The at least one higher level controller and/or lower level antenna element controllers may perform a processing operation on a first portion of a received multi-bit command message before receiving all bits of the multi-bit command message. This configuration advantageously provides a more efficient usage of processor time and may therefore reduce beam steering latency time and increase beam steering update rates.

Despite the significant advancements provided by the above-noted phased array antennas, further control features may be desired in certain applications, such as for communications applications, for example.

SUMMARY OF THE INVENTION

In view of the foregoing background, it is therefore an object of the present invention to provide a phased array antenna which provides a control architecture that is relatively easily scalable for large arrays, yet provides desired beam steering flexibility for various applications.

This and other objects, features, and advantages in accordance with the present invention are provided by a phased array antenna which may include a substrate and an array of antenna elements carried thereby, where the antenna elements may be arranged along an imaginary spiral. The antenna may further include at least one control element connected to each antenna element, and at least one controller serially communicating with the control elements so that updated control data for beam steering is sequentially implemented by the control elements to thereby cause a gradual change in beam steering.

Accordingly, the element array may advantageously be scaled to relatively large sizes and numerous geometries, yet still provide desired beam steering capabilities for relatively complex communications applications, for example. Moreover, this antenna configuration also advantageously allows aperture reconfiguration (e.g., aperture tapering and/or null steering), and beam reconfiguration (e.g., creating multiple beams via aperture splitting).

By way of example, the imaginary spiral may be an imaginary Archimedean spiral. More particularly, the antenna elements may be arranged in a plurality of subarrays, and the subarrays of antenna elements may be arranged along the imaginary spiral. Additionally, the antenna elements of each subarray may in turn be arranged along a respective imaginary spiral, to therefore provide a spiral array of spiral subarrays, which may advantageously be readily scaled to different sizes and numbers of elements for different applications, for example.

The control elements may be phase shifters and/or gain elements, for example. In addition, the at least one controller may provide multi-beam operation. Further, the antenna elements may be arranged in a plurality of subarrays, and the at least one controller may include a respective subarray controller connected to each subarray, a plurality of group controllers each connected to a respective group of subarray controllers, and a master controller connected to the group controllers. More particularly, a respective Universal Serial Bus (USB) may connect each group controller with its respective subarray controllers, and at least one Ethernet link may connect the master controller and the group controllers.

A method aspect of the invention is for controlling a phased array antenna, such as the one described briefly above. The method may include serially communicating with the control elements so that updated control data for beam steering is sequentially implemented by the control elements to thereby cause a gradual change in beam steering. This results in a very smooth movement of the beam in space even when digital phase shifters are used. For example, for a nominal large array with 6000 elements and five-bit digital phase shifting, using the architecture of the present invention the beam can be moved in small steps in space of 0.02 half-power beamwidths. This results in a beam steering loss of less than 0.03 dB.

A communications system is also provided in accordance with the invention and may include a communications device, such as a transmitter or receiver, connected to a phased array antenna, such as the one described briefly above.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
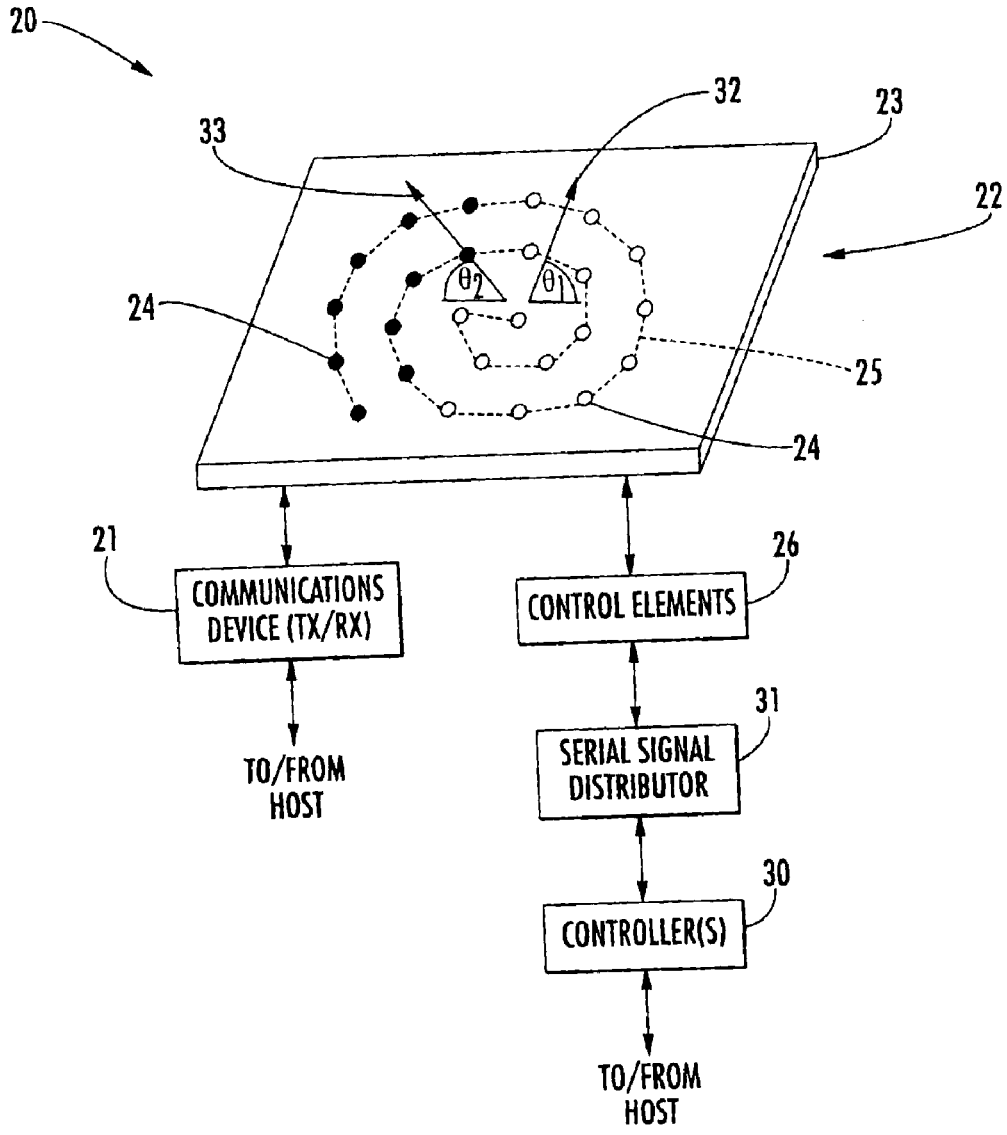
FIG. 1 is schematic block diagram of a communications system including a phased array antenna in accordance with the present invention.
Figure 2:
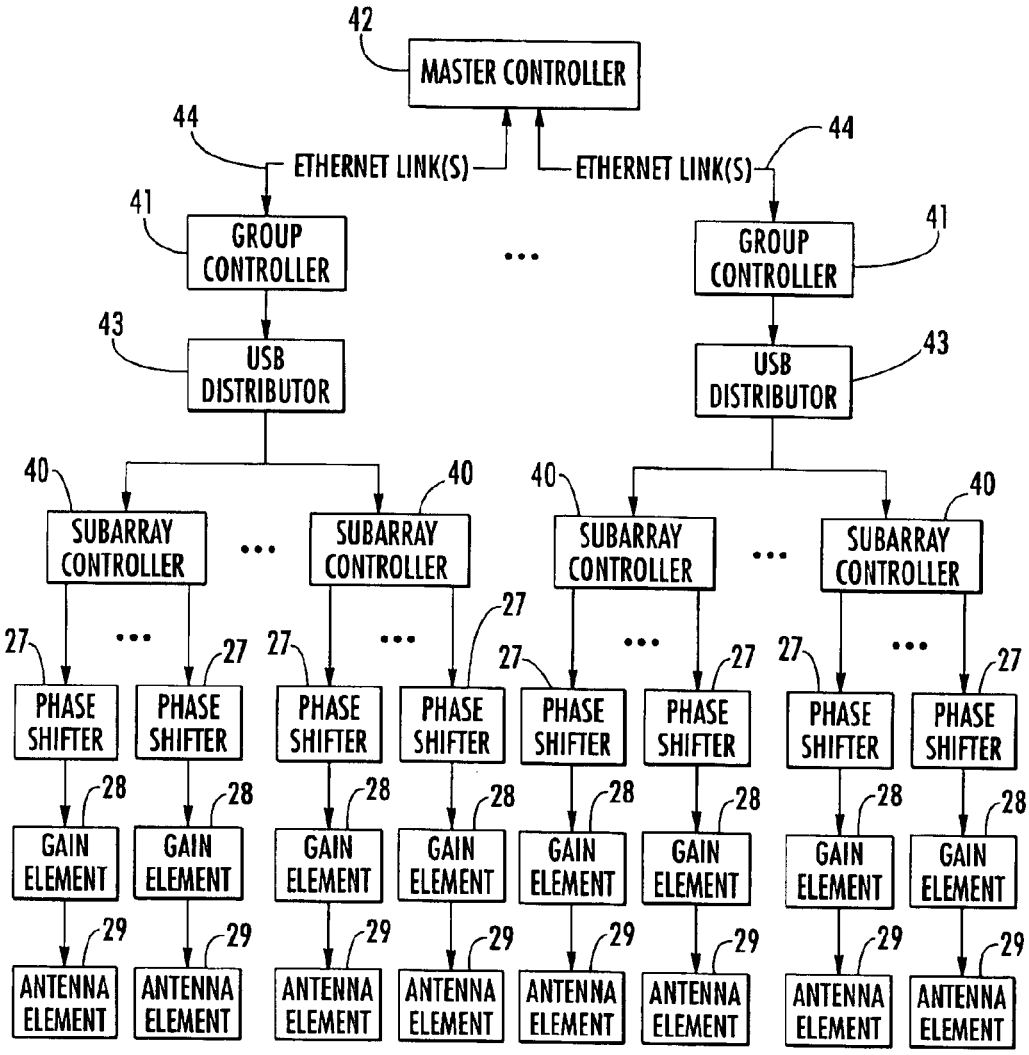
FIG. 2 is a schematic block diagram illustrating an embodiment of the phased array antenna of FIG. 1 in greater detail.
Figure 3:
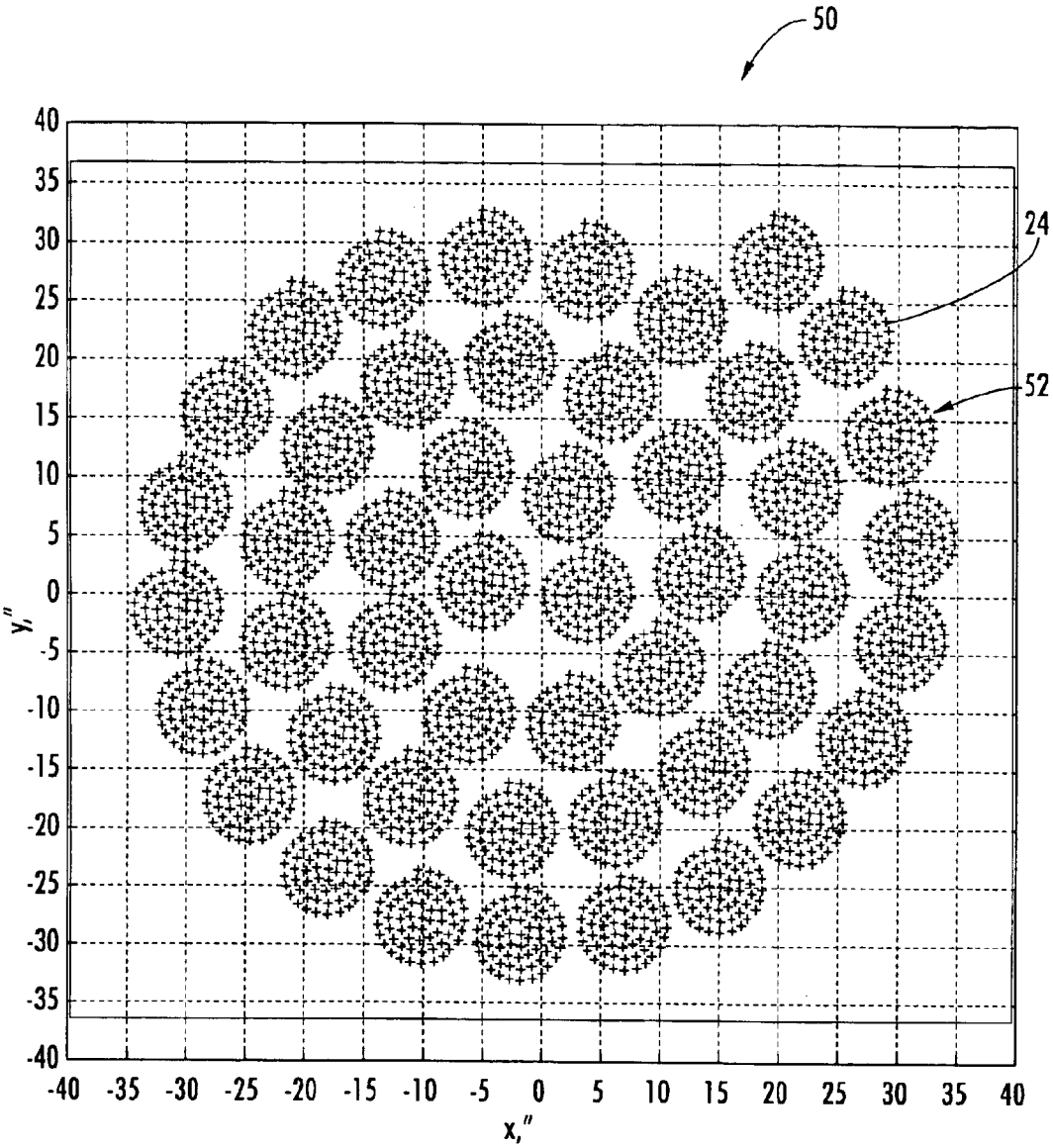
FIGS. 3–5 are top plan views of antenna element arrays and subarrays of an exemplary phased array antenna in accordance with the present invention.
Figure 4:
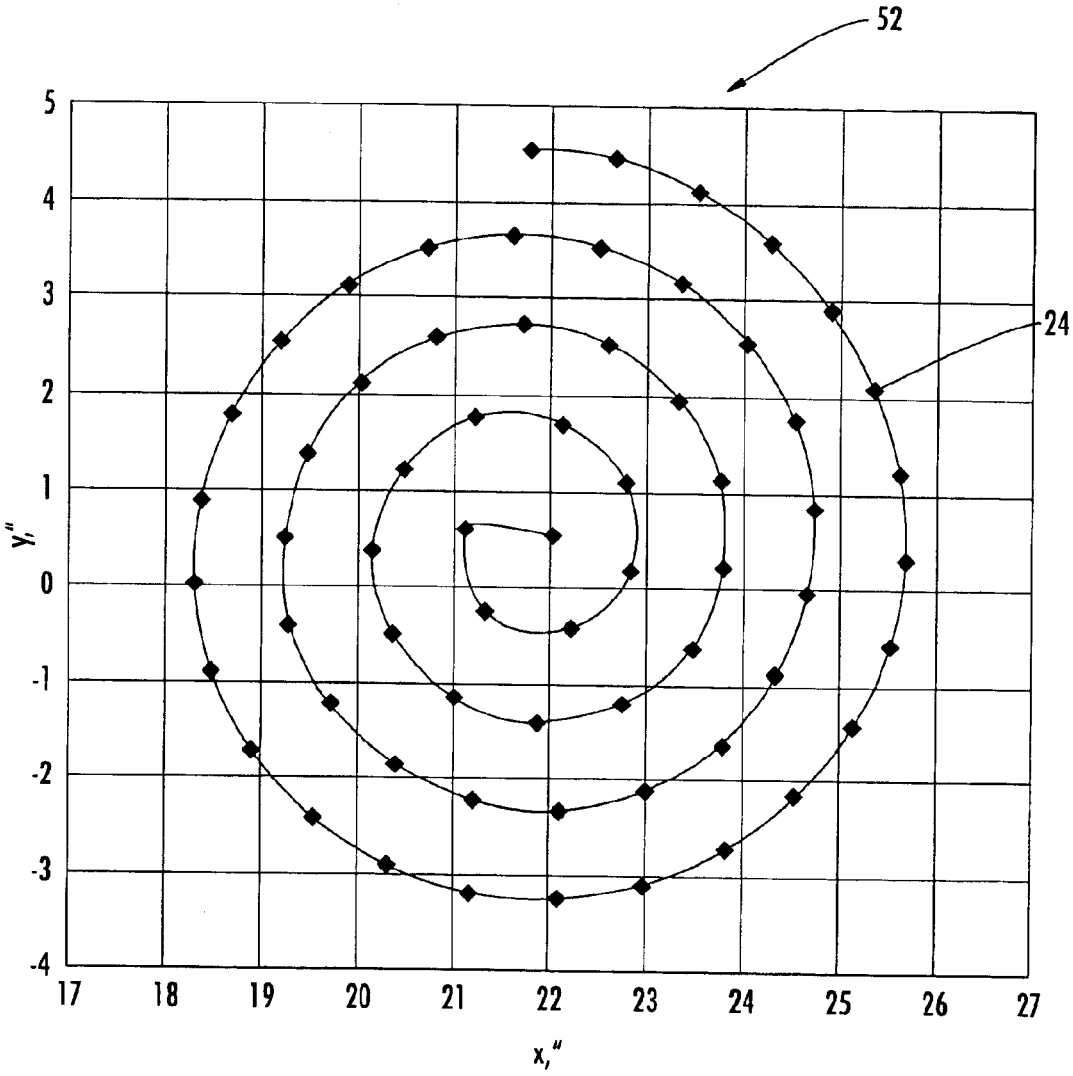
Figure 5:
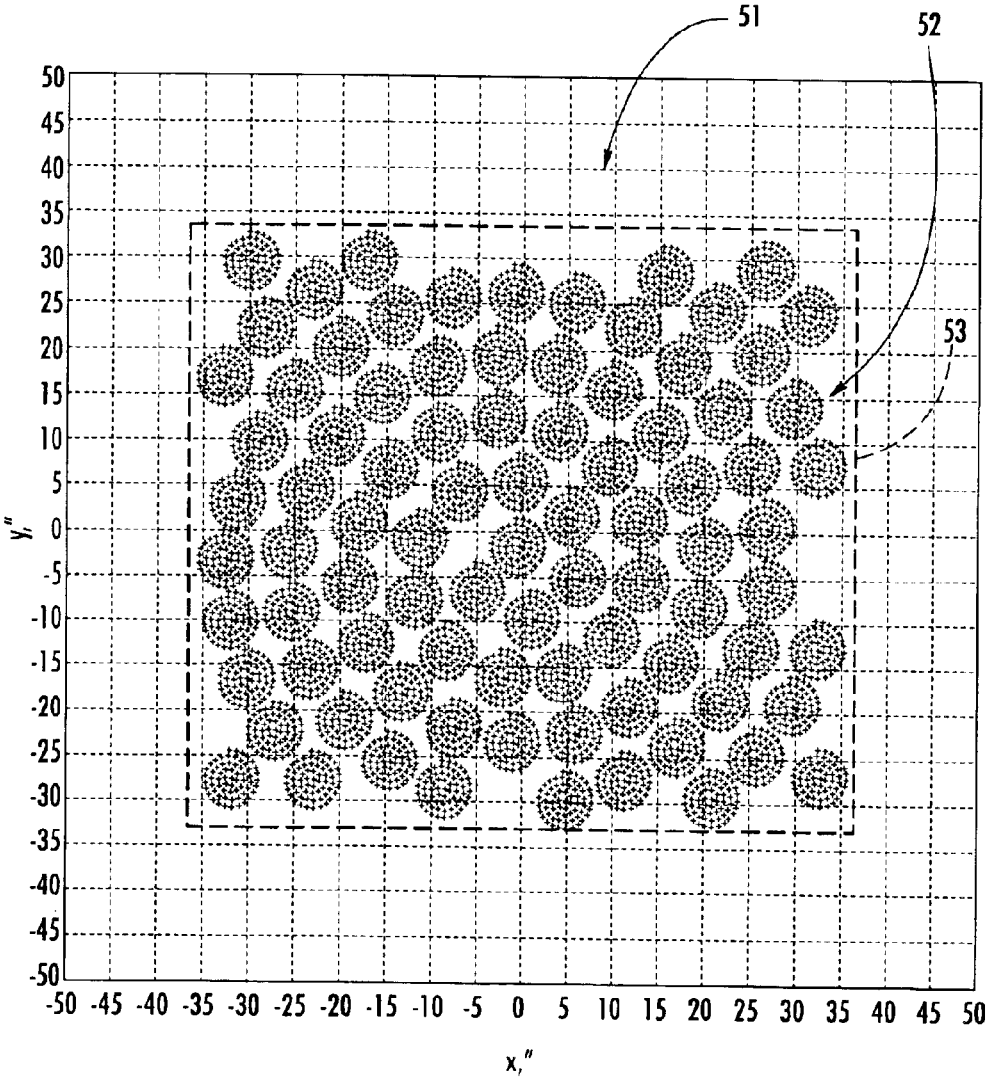

Referring initially to FIGS. 1 and 2, a communications system 20 in accordance with the present invention illustratively includes a communications device 21, such as a transmitter and/or receiver, and a phased array antenna 22. The phased array antenna 22 illustratively includes a substrate 23 and an array of antenna elements 24 carried thereby. In particular, the antenna elements 24 are preferably arranged along an imaginary spiral, which in the illustrated example is an Archimedean spiral.

Archimedean spiral array configurations may advantageously be used to reduce occurrences of grating and/or high-gain sidelobes, and they are relatively easily scalable from one implementation to the next. Further details regarding Archimedean spiral element arrays and the configuration thereof for different applications are provided in U.S. application Ser. No. 10/060,497 (U.S. Publication No. 2003/0142035), which is assigned to the present Assignee and is hereby incorporated herein in its entirety by reference. Other spiral configurations (e.g., log spirals) may also be used, as will be appreciated by those skilled in the art.

The phased array antenna 22 further illustratively includes one or more control elements 26 connected to each antenna element. In the exemplary embodiment of the phased array antenna 22 illustrated in FIG. 2, the control elements 26 include a respective phase shifter 27 and gain element 28 for each antenna element 24. The phased array antenna 22 also illustratively includes one or more controllers 30 for serially communicating with the control elements 26, such as via a serial signal distributor 31, so that updated control data for beam steering is sequentially implemented by the control elements to thereby cause a gradual change in beam steering.

More particularly, use of the serial signal distributor 31 advantageously allows signal routing to the various antenna elements 24 to be simplified so that the array may be expanded to relatively large sizes, as will be discussed further below. Yet, the phased array antenna 22 also takes advantage of the fact that in many applications beam steering changes do not have to occur simultaneously for each antenna element 24. For example, in radar applications, it is generally desirable to switch the antenna beam from one beam position to the next fairly rapidly and all at the same time, as will be appreciated by those skilled in the art.

On the other hand, communications transmissions between airborne/spaceborne platforms (i.e., airplanes, satellites), ground-based platforms, and sea-based platforms (i.e., ships), may not require such uniform changes across the antenna array, since these objects may move relatively slowly and consistently with respect to one another. In addition, high data rate communication antennas suffer higher bit error rates when all elements are switched at the same time. The phased array antenna 22 advantageously uses the serial signal distributor 31 so that element settings are sequentially implemented from one element 24 (or group of elements) to the next, which therefore gradually changes the beam rather than using a more complicated and complex parallel control architecture to implement all of the updated element settings uniformly at the same time. The phased array antenna 22 therefore avoids simultaneous switching of all elements at the same time, thus maintaining low bit error rates for continuous communications operation.

Such a sequential change in beam steering values across the array of antenna elements 24 is illustrated in FIG. 1. In the illustrated example, the array is in transition between first and second beam steering positions. More specifically, the antenna elements 24 whose currently implemented beam settings correspond to a first beam 32 at a scan angle $\theta_1$ are illustratively shown as empty circles. The antenna elements 24 whose beam settings have been sequentially updated to a second beam 33 at a scan angle $\theta_2$ to provide the illustrated gradual beam steering transition are illustratively shown as solid circles. It should be noted that while only two beams are shown for clarity of illustration, other numbers of beams may be used as well, as will be appreciated by those skilled in the art.

For applications in which larger numbers of antenna elements 24 are required, the antenna elements may be arranged in a plurality of subarrays, and the various control functions of the controller 30 may be distributed across multiple controllers arranged in a hierarchy. More particularly, each subarray of antenna elements 24 may have a respective subarray controller 40 connected to all of the elements therein, and groups of subarray controllers may in turn be connected to respective group controller 40. Moreover, a master controller 42 is at the top of the hierarchy and is connected to all of the group controllers 41.

Among other functions, the master controller 41 interfaces with a host, which typically provides the desired operational mode and desired beam direction/pattern. The master controller 42 processes and distributes this information to the lower level controllers 40, 41 for further processing and implementation as individual element settings, as will be appreciated by those skilled in the art. The various operations which may be performed by the controllers 40–42 will be discussed further in the example provided below.

In the embodiment illustrated in FIG. 2, the serial communications between the group controllers 41 and their respective subarray controllers 40 are advantageously implemented via respective Universal Serial Bus (USB) distributors 43, as will be appreciated by those skilled in the art. Also, one or more Ethernet links are preferably used to connect the master controller 42 and the group controllers 41. It should also be noted that in some embodiments the controllers may provide multi-beam operation. More particularly, groups of antenna elements 24 may be divided into subgroups, each for providing a different antenna beam, as will be appreciated by those skilled in the art. For example, groups may be split in half (i.e., two subgroups) to provide two separate beams, quarters (i.e., four subgroups) to provide four separate beams, or otherwise. Moreover, it will also be appreciated by those skilled in the art that the control architecture of the antenna 20 advantageously allows aperture reconfiguration (e.g., aperture tapering and/or null steering), and beam reconfiguration (e.g., creating multiple beams via aperture splitting).

EXAMPLE

The foregoing will be further understood with reference to an exemplary implementation of the phased array antenna 22, which is now described with reference to FIGS. 3–6. In the exemplary implementation, two separate reception arrays 50, 51 of antenna elements 24 were used, respectively, for X band communications and Ku band communications. However, it should be noted that the array structure described below may be used for other frequencies, as well as for transmitting, if desired. More particularly, the elements 24 were arranged in subarrays 52 of sixty-four or ninety-six elements 24 each, with each subarray arranged in an Archimedean spiral, as discussed above. Moreover, the subarrays 52 were, in turn, arranged along an Archimedean spiral, as shown, and the control architecture allowed for multi-beam operation.

The X band reception array 50 includes forty-eight Archimedean spiral subarrays 52 arranged along the Archimedean array spiral, while the Ku band reception array 51 includes ninety-six subarrays arranged in an Archimedean spiral which has been "cropped" to fit in the rectangular area 53. It should be noted that in other embodiments, the subarrays 52 and/or overall array could be arranged in other shapes (e.g., log spirals, etc.). In addition, different numbers of antenna elements 24 and/or subarrays 52 may also be used in different embodiments.

The control architecture of the exemplary phased array antenna is similar to the hierarchical structure illustrated in FIG. 2. Before discussing the exemplary control architecture implementation in greater detail, it is first helpful to note that a typical prior art high gain phased array antenna will generally have about 5,000 elements and element modules per array face. The costs of these arrays using complex Microwave Monolithic Integrated Circuit (MMIC) element modules have historically ranged from $2000 to $10,000 per element. The resulting cost of $10M to $100M per array face limits practicality of the array. Of this cost, the control system can contribute 10% or more.

The exemplary antenna provides significant cost savings over such prior art systems in several ways. One of these ways is that the antenna elements 24 and element control circuitry are implemented in a Circuit Card Assembly (CCA) panel which can be relatively easily scaled with the flexible control architecture for numerous applications. This also avoids the need for expensive MMIC element modules.

In addition, the hierarchical control system advantageously allows for significant reductions in cost, size, weight, and power of the control system with respect to certain prior art designs. That is, the layered and distributed control system features relatively simple and substantially identical, modular, subarray controllers 40 which are implemented along with their associated phase shifters 27, gain elements 28, and antenna elements 24 on the CCA panels. Moreover, respective group controllers 41 are provided for each panel, which are also referred to as panel controllers below, that can rapidly steer the array beam(s). As will be appreciated by those skilled in the art from the following description, the complexity and cost of this approach is significantly less than the "brute force" approach of certain communication system phased array antennas in which the array element control is performed only by a centralized computing processor.

Generally speaking, the control architecture of the exemplary antenna includes a four-layer distributed processing architecture in which the master controller 42 interfaces with a host and provides pointing angle and tracking loop information for the lower level controllers. At the panel level, the panel controllers 41 operate independently but in parallel with one another. At the sub-array level, parallel processing is also used to improve performance and scalability. In addition, at the element level, an $I^2C$ two-wire serial interface is used, which simplifies CCA layout, as will be appreciated by those skilled in the art.

Thus, the exemplary approach features a combination of layered and distributed architecture, simplifying the interconnect and processing requirements. Further, the subarray and panel controllers 40, 41 are modular, sharing much of the same hardware and software. The control architecture also allows commercial off-the-shelf (COTS), low cost, and relatively small processors to be used, which significantly cuts the overall control system power, cost, size, and weight. Additionally, the high commonality between controllers also reduces both hardware and software development costs, as will be appreciated by those skilled in the art.

Several important control considerations for the control architecture were as follows. It was desired that the system be relatively low in cost, size, weight, and power with respect to prior art designs. Moreover, a subarray controller architecture which consumed relatively little power (e.g., less than five Watts per controller 40) and a small footprint (e.g., less than nine sq. in.) was desired. Other considerations were as follows: to minimize interconnection complexity; to provide a serial control bus interconnect structure to simplify the RF CCA layout; to provide desired performance and scalability; and to be able to meet relatively high beam steering update rates (e.g., 1K Hz or Higher). It was also desired to provide a fully integrated development environment (IDE), and to provide for near and far-field nulling, as described further in co-pending application entitled COMMUNICATIONS SYSTEM INCLUDING PHASED ARRAY ANTENNA PROVIDING NULLING AND RELATED METHODS, which is hereby incorporated herein in its entirety by reference.

A minimum element spacing of 0.7 inches was selected for the antenna elements 24 in the subarrays 52 of the X band reception array 50, and a minimum spacing of 0.9 inches was selected for the subarrays of the Ku band reception array 51. Two Computer Software Configuration Items (CSCIs) were used, one for the panel controllers 41 and one for the subarray controllers 40. That is, all of the panel controllers 41 run a first CSCI, and all of the subarray controllers 40 run a second CSCI to provide a standardized and scalable architecture. The hardware interconnect design provides identification for the various panel controllers 41, and connector/wiring harnesses were encoded with an address, as will be appreciated by those skilled in the art. Moreover, parameters unique to any/all panel or sub-array positions were stored in files located in on-board FLASH memory. Also, the control software that was used has plug-and-play characteristics to facilitate installation and setup.

Operation of the above-described exemplary antenna is as follows. The panel controllers 41 are under the control of the master controller 42. The master controller 42 interfaces the host and performs functions such as steering calculation, inertial compensations, target tracking, system modeling, etc. The master controller 42 sends commands and collects status from the panel controllers 41 using a combination of fiber-optic Ethernet and RS-422 discrete signals, as will be appreciated by those skilled in the art.

The panel controllers 41 also perform a number of functions including distribution of steering commands, beam switching controls (i.e., mode selection based upon commands from the master controller 42), power supply control/sequencing, built-in-tests (BITs), antenna status, etc. In particular, the panel controllers 41 parse control and status commands, then distribute the appropriate commands to the subarray controllers 40. The subarray controllers 40 calculate the appropriate phase shifter, time-delay, and gain settings for their respective antenna elements 24, and they may optionally perform nulling, as noted above.

Control performance is enhanced by parallel computing the control equations at the subarray level, as noted above. More particularly, each subarray controller 40 performs the calculations for up to two beams by ninety-six elements, although other numbers of elements may also be used. Each subarray controller 40 begins calculations upon receipt of the beam steering command from the panel controller 41. The sequencing of the panel to subarray level commands, combined with the serialization of the control, ensures that although all the elements can be "steered" within about one millisecond, the updated control data for beam steering will be implemented sequentially to thereby provide gradual beam steering, as discussed above.

Turning more specifically to the panel controller 41 architecture, the architecture of the exemplary implementation included a COTS industrial EtherTrak ET-GT-3ES-2SC Ethernet switch. The processing circuitry was implemented with a Intrinsyc CerfBoard250 and a 400 MHz Intel PXA250 (XScale) CPU. The communications interface for the processing circuitry was implemented with an Intrinsyc CerfComm250, a USB 2.0 host port, a 10/100 Ethernet interface (Ethernet B), RS-232 (3 Wire) interface, field-programmable gate array (FPGA) based $I^2C$ and GPIO interfaces to provide subarray enable/disable and power supply controls. Moreover, redundant panel controllers 41 were also implemented for each panel, although redundancy need not be used in all embodiments.

The subarray controllers 40 include substantially the same processing architecture as the panel controllers 41, but use a different communications interface. More particularly, FPGA-controlled $I^2C$ Ports are used for phase shifter 27, time delay unit 51 (FIG. 6), and gain element 28 controls. FPGA-controlled general purpose input/output (GPIO) lines were used for power regulation. Advantageously, the total power consumed for a given subarray controller 40 was less than four Watts at five Volts. USB version 2.0 signal distribution was used between the subarray controllers 40 and respective panel controllers 41. Further, $I^2C$ was used between the subarray controller 40 and the control elements 26 for the antenna elements 24.

Figure 6:
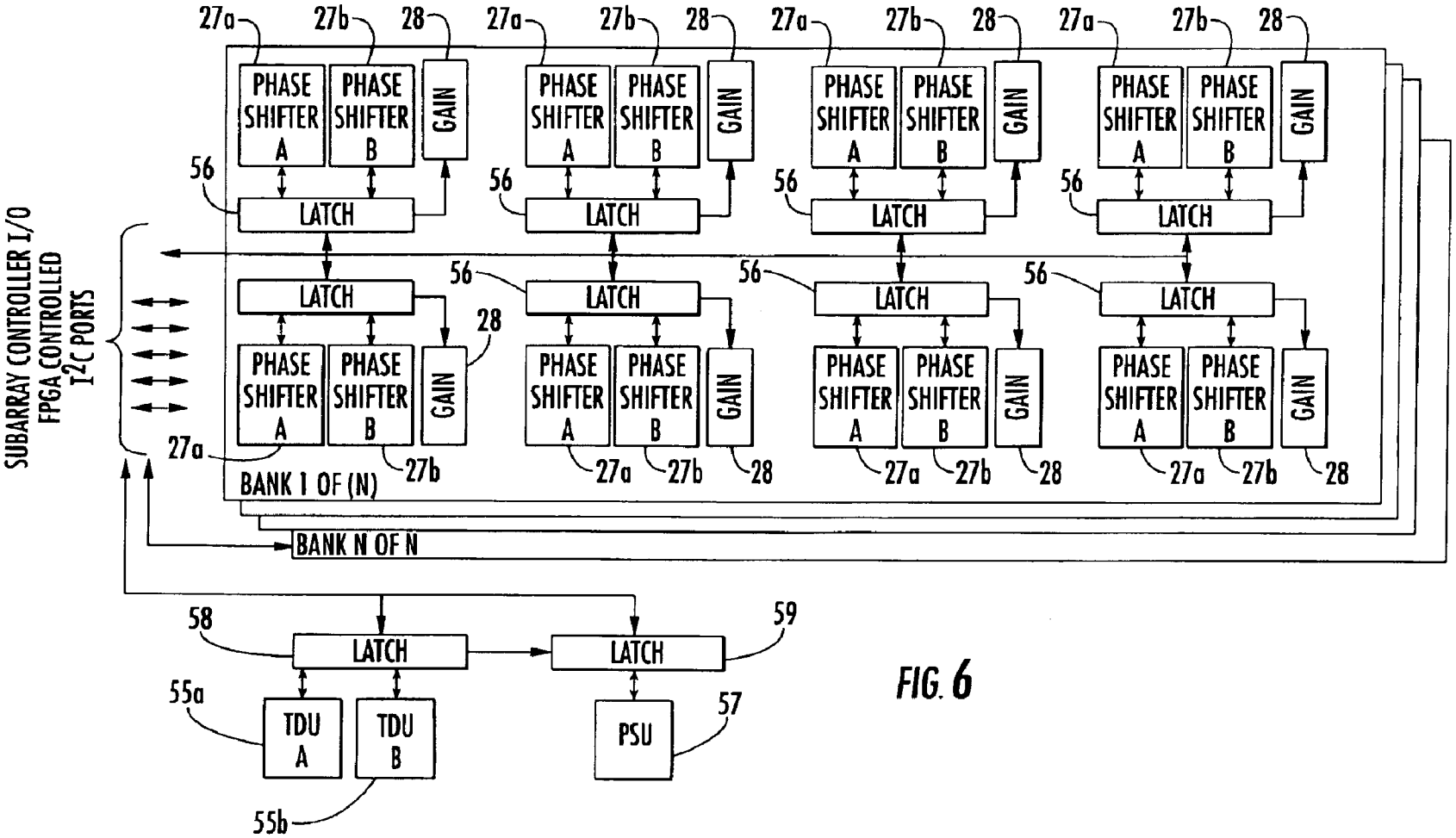
FIG. 6 is a schematic block diagram of exemplary antenna element control circuitry for the antenna arrays of FIGS. 3 and 5.

The element/physical level control circuitry is described further with reference to FIG. 6. This circuitry was implemented using respective pairs of five-bit phase shifters 27*a*, 27*b*, where one pair implements two beams for each element 24, and a respective gain element 28. Each pair of phase shifters 27*a*, 27*b* is controlled by a 16-Bit $I^2C$ bus latch 56, and several latches (e.g., eight in the exemplary embodiment) were strung together on a single $I^2C$ segment to form a "bank" of elements 24. Once again, an FPGA was used to implement an eight-channel $I^2C$ distribution architecture for the banks. This architecture advantageously reduces interconnect complexity and facilitates PCB layout. Compensated phase shift conversion lookup tables may be stored in the FLASH memory at the subarray controller 40, if desired. A respective power supply unit 57 is provided for each panel. A pair of time delay units 55*a*, 55*b* and power supply unit 57 for each panel are also interfaced via respective latches 58 and 59, as shown. It should be noted that other circuitry/components may be used for a phased array antenna control architecture in accordance with the present invention besides those listed above for the exemplary implementation, as will be appreciated by those skilled in the art.

A method aspect of the invention is for controlling the phased array antenna 22. The method includes serially communicating with the control elements 24 so that updated control data for beam steering is sequentially implemented by the control elements 26 to thereby cause a gradual change in beam steering, as described further above.

Although described above as applying to aperiodic arrangements of elements and subarrays or subgroups of elements, the control architecture of the present invention may also advantageously be applied to elements and subgroups of periodically arranged elements as well with attendant benefits, as will be appreciated by those skilled in the art.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array antenna comprising:

a substrate and an array of antenna elements carried thereby, said antenna elements being arranged along an imaginary spiral;

at least one control element connected to each antenna element; and at least one controller serially communicating with said control elements so that updated control data for beam steering is sequentially implemented by said control elements to thereby cause a gradual change in beam steering.

2. The phased array antenna of claim 1 wherein the imaginary spiral comprises an imaginary Archimedean spiral.

3. The phased array antenna of claim 1 wherein said antenna elements are arranged in a plurality of subarrays, and wherein said subarrays of antenna elements are also arranged along the imaginary spiral.

4. The phased array antenna of claim 3 wherein said antenna elements of each subarray are also arranged along a respective imaginary spiral.

5. The phased array antenna of claim 1 wherein said control elements comprise phase shifters.

6. The phased array antenna of claim 1 wherein said control elements comprise gain elements.

7. The phased array antenna of claim 1 wherein said at least one controller provides multi-beam operation.

8. The phased array antenna of claim 1 wherein said at least one controller provides aperture reconfiguration.

9. The phased array antenna of claim 1 wherein said at least one controller provides beam reconfiguration.

10. The phased array antenna of claim 1 wherein said antenna elements are arranged in a plurality of subarrays; and wherein said at least one controller comprises a respective subarray controller connected to each subarray, a plurality of group controllers each connected to a respective group of subarray controllers, and a master controller connected to said group controllers.

11. The phased array antenna of claim 10 further comprising a respective Universal Serial Bus (USB) connecting each group controller with its respective subarray controllers.

12. The phased array antenna of claim 10 further comprising at least one Ethernet link connecting said master controller and said group controllers.

13. A phased array antenna comprising:

a substrate and an array of antenna elements carried thereby, said antenna elements being arranged along an imaginary spiral;

at least one gain element connected to each antenna element;

at least one phase element connected to each antenna element; and at least one controller serially communicating with said gain elements and said phase shifters so that updated control data for beam steering is sequentially implemented by said control elements to thereby cause a gradual change in beam steering.

14. The phased array antenna of claim 13 wherein the imaginary spiral comprises an imaginary Archimedean spiral.

15. The phased array antenna of claim 13 wherein said antenna elements are arranged in a plurality of subarrays, and wherein said subarrays of antenna elements are also arranged along the imaginary spiral.

16. The phased array antenna of claim 15 wherein said antenna elements of each subarray are also arranged along a respective imaginary spiral.

17. The phased array antenna of claim 13 wherein said at least one controller provides multi-beam operation.

18. The phased array antenna of claim 13 wherein said antenna elements are arranged in a plurality of subarrays; and wherein said at least one controller comprises a respective subarray controller connected to each subarray, a plurality of group controllers each connected to a respective group of subarray controllers, and a master controller connected to said group controllers.

19. The phased array antenna of claim 18 further comprising a respective Universal Serial Bus (USB) connecting each group controller with its respective subarray controllers.

20. The phased array antenna of claim 18 further comprising at least one Ethernet link connecting said master controller and said group controllers.

21. A communications system comprising:

a communications device and a phased array antenna connected thereto, said phased array antenna comprising a substrate and an array of antenna elements carried thereby, said antenna elements being arranged along an imaginary spiral, at least one control element connected to each antenna element, and at least one controller serially communicating with said control elements so that updated control data for beam steering is sequentially implemented by said control elements to thereby cause a gradual change in beam steering.

22. The communications system of claim 21 wherein said communications device comprises a transmitter.

23. The communications system of claim 21 wherein said communications devices comprises a receiver.

24. The communications system of claim 21 wherein the imaginary spiral comprises an imaginary Archimedean spiral.

25. The communications system of claim 21 wherein said antenna elements are arranged in a plurality of subarrays, and wherein said subarrays of antenna elements are also arranged along the imaginary spiral.

26. The communications system of claim 25 wherein said antenna elements of each subarray are also arranged along a respective imaginary spiral.

27. The communications system of claim 21 wherein said control elements comprise at least one of phase shifters and gain elements.

28. The communications system of claim 21 wherein said at least one controller provides multi-beam operation.

29. The communications system of claim 21 wherein said antenna elements are arranged in a plurality of subarrays; and wherein said at least one controller comprises a respective subarray controller connected to each subarray, a plurality of group controllers each connected to a respective group of subarray controllers, and a master controller connected to said group controllers.

30. A method for controlling a phased array antenna comprising a substrate and an array of antenna elements carried thereby where the antenna elements are arranged along an imaginary spiral, and at least one control element connected to each antenna element, the method comprising:

serially communicating with the control elements so that updated control data for beam steering is sequentially implemented by the control elements to thereby cause a gradual change in beam steering.

31. The method of claim 30 wherein the imaginary spiral comprises an imaginary Archimedean spiral.

32. The method of claim 30 wherein the antenna elements are arranged in a plurality of subarrays, and wherein the subarrays of antenna elements are also arranged along the imaginary spiral.

33. The method of claim 32 wherein the antenna elements of each subarray are also arranged along a respective imaginary spiral.

34. The method of claim 30 wherein the control elements comprise at least one of phase shifters and gain elements.

35. The method of claim 30 further comprising controlling the antenna elements to provide multi-beam operation.

* * * * *